United States Patent [19]

Stuart

[11] 3,934,166

[45] Jan. 20, 1976

[54] OFFSET STINGER FOR ARC LAMP

[75] Inventor: William R. Stuart, San Carlos, Calif.

[73] Assignee: Varian Associates, Palo Alto, Calif.

[22] Filed: Aug. 23, 1974

[21] Appl. No.: 500,204

Related U.S. Application Data

[62] Division of Ser. No. 424,399, Dec. 13, 1973.

[52] U.S. Cl. ..... 313/146; 313/152; 313/217; 313/356

[51] Int. Cl.[2] ..... H01J 1/02; H01J 1/44; H01J 1/52; H01J 1/88

[58] Field of Search ..... 313/152, 217, 354, 356, 313/146

[56] References Cited

UNITED STATES PATENTS

| | | | |
|---|---|---|---|
| 2,156,369 | 5/1939 | Bay | 313/152 X |
| 2,545,345 | 3/1951 | Deri | 313/152 X |
| 3,452,236 | 6/1969 | Beese | 313/152 |
| 3,529,209 | 9/1970 | Lienhard et al. | 313/152 X |
| 3,555,339 | 1/1971 | Peacher | 313/152 |
| 3,588,572 | 6/1971 | Beese | 313/152 |

*Primary Examiner*—Saxfield Chatmon, Jr.
*Attorney, Agent, or Firm*—Stanley Z. Cole; Leon F. Herbert; John J. Morrissey

[57] ABSTRACT

In a gas-filled lamp an arc is initiated by withdrawal of a stinger electrode from contact with a stationary cathode, with subsequent transfer of the arc to the gap between the cathode and a stationary anode. The anode is cylindrical; and the stinger is elongate and is movably mounted within and electrically insulated from the anode. The cathode is elongate, having a long axis parallel to but spaced apart from the long axis of the stinger. The stinger contacts the cathode at other than the tip of the cathode, thereby precluding continual impacting of the stinger on the cathode tip with concomitant blunting of the cathode tip during the use cycle of the lamp. A magnetic core is affixed to the stinger, whereby the stinger can be moved by the energization of a solenoid. The magnetic core is apertured to provide a dashpot effect to damp the motion of the stinger.

7 Claims, 3 Drawing Figures

OFFSET STINGER FOR ARC LAMP

This is a division of application Ser. No. 424,399 filed Dec. 13, 1973.

BACKGROUND OF THE INVENTION

1. Field of the Invention

This invention is a further development with respect to gas-filled arc lamps. In particular, an improved electrode configuration is provided for an arc lamp in which the arc is initiated by the withdrawal of a stinger electrode from contact with a first stationary electrode with subsequent transfer of the arc to the gap between the first stationary electrode and a second stationary electrode.

2. Description of the Prior Art

The technique of initiating an arc in an enclosure filled with an ionizable gas by using a stinger electrode to draw the arc from one stationary electrode to another stationary electrode is well known. This technique has been used, for example, by Edward T. Chan in the invention disclosed in Patent application Ser. No. 337,234, filed on Mar. 1, 1973, now U.S. Pat. No. 3,876,908 Varian Associates, assignee of the present invention. In the Chan application, an electric circuit is provided whereby a low-voltage power supply can be used to start a gas-filled arc lamp wherein the arc is initiated by the withdrawal of a stinger from contact with a stationary cathode, with subsequent transfer of the arc to the gap between the cathode and a stationary anode.

In a plasma discharge arc between a cathode and an anode, the brightest portion of the arc occurs in a small region of the arc located immediately adjacent the tip of the cathode. Most of the light from the arc originates in this small region, which is called the "hot spot." In an arc lamp, in order to maximize the amount of light reflected out through the lamp window, it is necessary to fixedly position the tip of the cathode with respect to the reflector so that the hot spot remains constantly at the focus of the reflector during lamp operation. A technique for fixedly positioning the tip of the cathode with respect to the focus of the reflector is disclosed in U.S. Pat. No. 3,725,714, which issued on Apr. 3, 1973 to Norman C. Anderson and which is assigned to Varian Associates.

In an arc lamp of the type disclosed in the Chan application mentioned above, it is desirable to mount the cathode with respect to the reflector so that the tip of the cathode will remain fixedly positioned with respect to the focus of the reflector, not only during the manufacturing process but also throughout the expansion and contraction of the lamp components during the lamp's use cycle. The mounting technique disclosed in the Anderson patent mentioned above assures that the cathode itself will remain fixedly positioned with respect to the reflector during temperature cycling of the lamp. However, it has been found that repeated impacting of the stinger on the tip of the cathode tends to blunt the cathode tip, thereby changing the location of the hot spot of the arc relative to the focus of the reflector.

SUMMARY OF THE INVENTION

This invention provides an electrode configuration for an arc lamp whereby the repeated impacting of a stinger electrode against a fixed electrode during the use cycle of the arc lamp will not blunt the tip of the fixed electrode.

Accordingly, it is an object of this invention to provide an arc lamp in which the arc is initiated by the withdrawal of a stinger from contact with a fixed cathode, with subsequent transfer of the arc to the gap between the cathode and a fixed anode, wherein the stinger makes contact with the cathode at other than the tip of the cathode.

It is likewise an object of this invention to provide an arc lamp in which the electrodes comprise a cylindrical fixed anode, an elongate stinger movably mounted within and electrically insulated from the anode, and an elongate fixed cathode, wherein the long axis of the cathode is parallel to but spaced apart from the long axis of the stinger in such a way that the stinger does not come into contact with the tip of the cathode during the use cycle of the lamp.

It is a further object of this invention to provide an arc lamp wherein the movement of a stinger electrode in either direction between an extended position in contact with a fixed electrode and a retracted position away from contact with the same fixed electrode is damped by the dashpot effect of gas within the lamp passing through an aperture in a member affixed to the stinger.

DESCRIPTION OF THE PREFERRED EMBODIMENT

Figure 1:
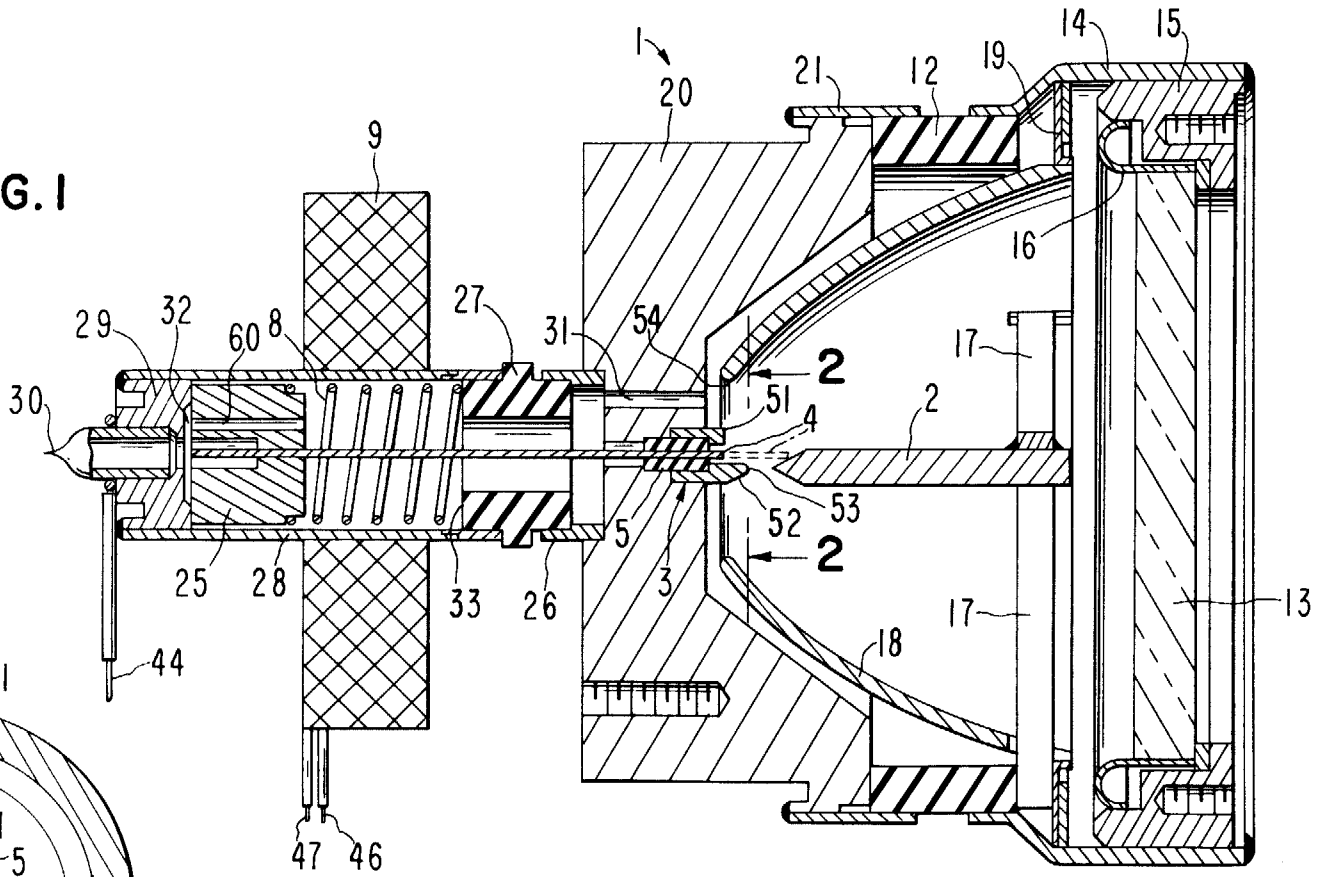
FIG. 1 shows a cross-sectional view of an arc lamp according to this invention.

As shown in FIG. 1, the arc lamp of this invention comprises a gas-filled hermetically sealed envelope 1, typically containing xenon gas. An elongate metal cathode 2 is fixedly mounted within the envelope. A metal anode 3 in the form of a hollow cylindrical structure is likewise fixedly mounted within the envelope, with the axis of the cylindrical anode structure 3 being parallel to yet spaced apart from the long axis of the cathode 2. The cathode 2 and the anode 3 are mounted so that a gap separates an apical end portion of one of these electrodes from an apical end portion of the other of these electrodes. A third electrode, which is an elongate metal stinger 4, is disposed coaxially within the hollow anode structure 3 and is electrically insulated therefrom by an insulating sleeve 5. The stinger 4 is slidably movable within the bore of the insulating sleeve 5 from a retracted position at which the tip of the stinger is completely withdrawn into the cylindrical anode structure 3 (as shown by solid lines) to an extended position at which the tip of the stinger contacts the cathode 2 at other than the tip of the cathode (as shown by broken lines). The stinger 4 is mechanically biased by a metal spring 8 to remain in the retracted position. Movement of the tip of the stinger out of the anode structure 3 into the gap between the anode and the cathode occurs when solenoid coils 9 are energized, which counteracts the mechanical bias of the spring 8.

The arc lamp also comprises a generally cylindrical ceramic side envelope wall member 12. A transparent window disc 13 is hermetically sealed to the front end of ceramic cylinder 12 by means of metal rings 14, 15 and 16 all brazed together. Ring 14 is metallically bonded to the ceramic cylinder 12, and ring 16 is metallically bonded to the window 13. Cathode 2 is bonded to metal support arms 17 which extend radially out through slots in a reflector 18 adjacent the front edge thereof to a metal support ring 19. Support arms 17 are brazed to support ring 19, which is brazed to ring 14, thereby forming a continuous electrical path from the cathode 2 to the outer metal ring 14 which cylindrically surrounds the front portion of the lamp, i.e., which encompasses all portions of the window-end of the lamp mounted forwardly of the insulating ceramic cylinder 12. The front end of the reflector 18 is also brazed to support ring 19, so that the reflector 18 maintains the same electrical potential as the cathode 2. Since the window-end of the lamp is the end that is exposed to the external environment, it is contemplated that the cathode 2, and therefore all components at the same electrical potential as the cathode, will be maintained at ground potential.

Anode 3 is brazed in a bore provided in massive metal base member 20, which serves to conduct heat away from the anode. Base member 20 is electrically insulated from the forwardly mounted members of the lamp by means of ceramic cylinder 12. A hermetic seal is provided between base member 20 and ceramic cylinder 12 by metal ring 21 which cylindrically surrounds adjacent portions of base member 20 and ceramic cylinder 12. Base member 20 is bonded to ring 21 by brazing, and ceramic cylinder 12 is bonded to ring 21 by any well-known ceramic-to-metal sealing technique applied to the outside rim portion of the ceramic cylinder 12 adjacent ring 21. Ring 21 also serves to provide an electrical lead path through base member 20 to the anode 3, whereby anode 3 can be maintained at an electrical potential different from cathode 2. Within the hollow anode structure 3, insulating sleeve 5 is metallically bonded thereto. Stinger 4 is slidably movable within the bore of insulating sleeve 5 and is prevented by sleeve 5 from contacting the anode 3, so that the anode and the stinger are electrically isolated from each other.

Affixed to the rear of base member 20, surrounding the bore in which anode 3 is brazed, is a metal cylinder 26. Hermetically bonded to metal cylinder 26 is a ceramic insulating cylinder 27, and hermetically bonded to ceramic insulating cylinder 27 is a metal cylinder 28. Cylinders 26, 27 and 28 are coaxial with the long axis of stinger 4, and serve to house the elongate stinger. Metal cylinder 28, at its end remote from ceramic cylinder 27, terminates with a metal end plug 29 and with a metal pinch-off tubulation 30. The inner walls of cylinders 26, 27 and 28 and of end plug 29 and pinched off tubulation 30 comprise portions of the hermetically sealed envelope 1, with gas communication from the window side to the solenoid side of base member 20 being provided by a bore 31 through base member 20. Ceramic cylinder 27 serves to electrically isolate metal cylinder 28 from metal cylinder 26 and therefore from anode 4. The inside diameter of ceramic cylinder 27 is smaller than the inside diameter of the adjoining metal cylinder 28, so that the end of ceramic cylinder 27 remote from metal cylinder 26 presents to the region within metal cylinder 28 a wall-like barrier 33 having a central apertured portion through which the stinger 4 can pass. The bore 31 in base member 20 and the recess 32 in the inner surface of end plug 29 permit evacuation of the lamp and subsequent filling thereof with a desired ionizable gas through tubulation 30 before it is pinched off.

Solenoid coils 9 surround cylinder 28. Attached to the end of stinger 4 remote from the cathode 2 is a magnetic core 25 as of iron, which fits slidingly within cylinder 28. The metal spring 8 is disposed within cylinder 28 between the iron core 25 and the apertured wall 33 which is presented by cylinder 27. Spring 8 is biased to keep the iron core 25 in contact with the end plug 29. When the solenoid coils 9 are energized through lead lines 46 and 47, the iron core 25, which is the armature of the solenoid, is caused to move forwardly against the spring bias. Stinger 4, which is affixed to the iron core 25, is thereby carried forward to the position shown by broken lines in FIG. 1 into contact with cathode 2. An electrical path is maintained from lead line 44 to the stinger 4 by the sliding contact which exists between the iron core 25 and the inner wall of metal cylinder 28, and by the contact of spring 8 with both iron core 25 and metal cylinder 28. Lead line 44 makes electrical contact with metal end plug 29 which is brazed to metal cylinder 28. To initiate the arc, the solenoid coils 9 are first energized to bring the stinger 4 into contact with the cathode 2. A power supply is also connected to the cathode 2, the anode 3 and the stinger 4. (One suitable circuit for connecting a power supply to these electrodes is disclosed in the above-mentioned Patent application Ser. No. 337,234 now U.S. Pat. No. 3,876,908.) Then, the solenoid coils 9 are deenergized. The mechanical bias of spring 8 thereupon causes the stinger 4 to be retracted from contact with cathode 2 to a position, as shown by solid lines in FIG. 1, at which the tip of the stinger is within the region enclosed by the cylindrical anode structure 3. As the tip of the stinger separates from contact with the cathode 2, a difference of electric potential develops between the stinger 4 and the cathode 2, which is sufficient to ionize the gas in the gap therebetween. As the stinger 4 withdraws into the anode structure, the arc in the gap between the stinger 4 and the cathode 2 initially "follows" the stinger 4. However, as the tip of stinger 4 moves into the region enclosed by the anode structure 3, the arc will "jump" to the apex of the anode 3 as will be discussed more fully below. After the arc has been created, it can thereafter be maintained at a typical current value of about 50 amperes with a typical difference of electrical potential of about 20 volts between the anode 3 and the cathode 2.

The principal feature of this invention is that the electrodes are configured so that the stinger 4 does not impact the cathode 2 at the cathode tip when solenoid 9 is energized. In a plasma discharge arc between a cathode and an anode, the brightest portion of the arc occurs in a small region of the arc located immediately adjacent the tip of the cathode. Most of the light from the arc originates in this small region, which is called the "hot spot." In an arc lamp, in order to maximize the amount of light reflected out through the lamp window, it is necessary to fixedly position the tip of the cathode with respect to the reflector so that the hot spot remains constantly at the focus of the reflector throughout the use cycle of the lamp. In the arc lamps known to the prior art, wherein the arc is initiated by withdrawing a stinger from contact with a stationary cathode, the stinger continually impacts the tip of the cathode throughout the use cycle of the lamp. In other words, every time a prior-art lamp is to be started, the stinger is driven by a solenoid into collision with the tip of the stationary cathode. Such continual impacting of the stinger on the cathode tip results in blunting of the cathode tip with a resulting change in the location of the cathode tip relative to the reflector. Such deformation of the cathode tip is especially severe when the lamp is to be turned on, off, and on again within a short period of time. After the arc is initiated, the tip of the cathode becomes white hot. If the lamp is turned off, and then the arc is reinitiated before the cathode has had a chance to cool off, the momentum transfer caused by the impacting of the stinger 4 on the hot cathode tip will readily cause deformation of the cathode tip. It should be noted that it is important for the cathode tip to terminate in as sharp a point as possible in order that the position of the hot spot can be defined as precisely as possible. The surface of the reflector is usually a concave surface, at least a portion of which is designed to be a surface of revolution whose foci can be determined by optical techniques. Since the hot spot may for practical purposes be taken to lie immediately adjacent the cathode tip, it is desirable to locate the cathode tip precisely at a focus of the reflector, or at the focus of a particular portion of the reflector which comprises a segment of a particular surface of revolution. If, for example, the reflector surface comprises a segment of an ellipsoid, it may be desirable to locate the cathode tip such that the brightest spot in the arc gap, i.e., the hot spot, will be positioned precisely at the internal focus of that ellipsoid so that the maximum amount of light will be reflected out through the arc lamp window.

To achieve the object of this invention which is to preclude impacting of the stinger on the apex of the stationary cathode, the electrodes are configured so that the axis of the stinger is offset from the axis of the cathode whereby the stinger will make contact with the cathode at other than the cathode tip. As is shown in FIG. 1, the stinger 4 and anode 3 are coaxial with each other; and the coaxes of the stinger 4 and of the anode 3 is parallel to but spaced apart from the axis of the cathode 2. The stinger 4 will therefore impact the cathode 2 at a place on the cathode 2 where the PSI loading, i.e., the momentum transfer in a given time interval per unit area expressed in pounds per square inch, will be much lower than at the tip of the cathode. As can be seen in FIG. 1, the tip of the stinger 4 is shaped to present a flat contact interface with the area of the cathode 2 which it impacts. This feature results in the lowest possible PSI loading on the cathode 4, and would not have been possible if the stinger were required to impact the cathode 4 at the cathode tip.

Figure 3:
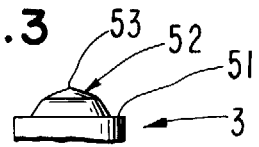
FIG. 3 shows a side elevational view of the anode shown in FIG. 2 viewed along a line 3—3 in the direction of the arrows.
Figure 2:
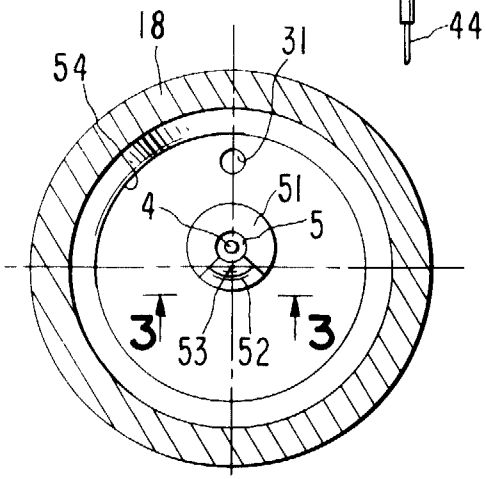
FIG. 2 shows a frontal view of the lamp shown in FIG. 1 viewed along line 2-2 in the direction of the arrows.

A further improvement which this invention provides over the prior art lies in the design of the anode structure 3. According to the prior art, a suitable anode structure would be a hollow cylindrical metal structure completely symmetrical about its axis. In a prior art lamp, as the stinger was withdrawn into the anode structure, the arc in the gap between the stinger and the cathode would "jump" from the stinger to some place on the edge of the anode facing the tip of the cathode as soon as the gap distance between the tip of the stinger and the cathode tip became greater than the gap distance between a point on the edge of the anode and the cathode tip. Since the anode structure in the prior art was symmetrical about its axis, all points on the anode edge facing the tip of the cathode were (in principle) equally distant from the cathode tip. Thus, there was no dominating tendency according to the prior-art anode design for the arc to prefer one point on the anode edge to any other point thereon. The arc could therefore fluctuate in a conical pattern, with the apex of the cone being at the cathode tip and the base of the cone being the circular edge of the anode. The tendency of the arc to "roam" around the edge of the anode was an instability that increased the likelihood that the arc might jump to some other metal component of the lamp at anode potential. The most stable arc, i.e., the arc least likely to jump to other metal components of the lamp, would be an arc that is maintained in a gap between only two points, which two points are closer together than any other two points between which the arc discharge is possible. Therefore, according to this invention, the anode 3 is designed to have an apex 53 that is closer than any other portion of the anode 3 to the tip of the cathode 2. As can be seen in FIG. 1, the anode 3 has a flat end face 51 perpendicular to the axis of the cathode 2, with a spike-like projection 52 extending from the end face 51 toward the cathode 2. This projection 52 is shown in frontal view in FIG. 2 and in side elevation in FIG. 3. The apex 53 of projection 52 is disposed coaxially with the tip of the cathode 2 on the axis of cathode 2. This disposition of apex 53 is possible because the axis of cylindrical anode structure 3 is offset from the axis of cathode 2. Thus, apex 53 is closer than anyother portion of anode 3 to the tip of cathode 2. An arc initiated in the gap between anode 3 and cathode 2 will therefore stabilize between unique points on each electrode, i.e., between the apex 53 of the anode 3 and the tip of the cathode 2.

Another improvement which this invention provides over the prior art resides in the provision of channel 60 through iron core 25, whereby a dashpot effect is created as the iron core 25 moves within the housing cylinder 28. Gas within the envelope 1 passes through channel 60 as the stinger 4 is moved in either direction. The resulting dashpot effect serves to damp the motion of the stinger, thereby preventing unnecessarily jarring impacts either of the stinger 4 on the cathode 2 or of the iron core 25 on the end plug 29.

Since changes could be made in particular details of the embodiment of the invention disclosed herein without departing from the scope of the invention, it is intended that the above description and accompanying drawing be interpreted as illustrative only and not as limiting.

What is claimed is:

1. An arc lamp electrode comprising a generally cylindrical metal structure, with a bore extending from one end thereof into the interior of said structure, said one end having a face circumferentially surrounding said bore, said face being generally planar except for an integral portion thereof which projects therefrom generally parallel to the axis of said cylindrical structure.

2. The electrode of claim 1 wherein said bore is generally coaxial with said cylindrical metal structure.

3. The electrode of claim 1 wherein said generally planar portion of said face is generally perpendicular to the axis of said cylindrical structure.

4. The electrode of claim 1 wherein said projecting portion of said face is a minor portion of said face.

5. The electrode of claim 1 further comprising means for mounting another electrode within the interior of said metal structure in electrical isolation therefrom.

6. The electrode of claim 5 wherein said mounting means comprises an electrically insulating sleeve disposed within the bore of said cylindrical metal structure, said sleeve itself having a bore within which said other electrode may be disposed.

7. The electrode of claim 6 in combination with another electrode disposed within the bore cf said electrically insulating sleeve.

* * * * *